US010647385B2

(12) United States Patent
Keller et al.

(10) Patent No.: US 10,647,385 B2
(45) Date of Patent: May 12, 2020

(54) ADVANCES IN WATERCRAFT HULL LIFT, EFFICIENCY, AND REDUCED HUMP DRAG WITH INCREASED STABILITY

(71) Applicants: John H. Keller, Newburgh, NY (US); John Wallace Keller, Portland, OR (US)

(72) Inventors: John H. Keller, Newburgh, NY (US); John Wallace Keller, Portland, OR (US)

( * ) Notice: Subject to any disclaimer, the term of this patent is extended or adjusted under 35 U.S.C. 154(b) by 0 days.

(21) Appl. No.: 16/115,823

(22) Filed: Aug. 29, 2018

(65) Prior Publication Data

US 2019/0061879 A1 Feb. 28, 2019

Related U.S. Application Data

(60) Provisional application No. 62/551,478, filed on Aug. 29, 2017.

(51) Int. Cl.
*B63B 1/20* (2006.01)
*B63B 1/04* (2006.01)

(52) U.S. Cl.
CPC ..... *B63B 1/20* (2013.01); *B63B 1/042* (2013.01); *B63B 2001/201* (2013.01); *B63B 2001/202* (2013.01)

(58) Field of Classification Search
CPC ..... B63B 1/042; B63B 2001/202; B63B 2001/203
See application file for complete search history.

(56) References Cited

U.S. PATENT DOCUMENTS

| | | | |
|---|---|---|---|
| 1,618,995 | A | 3/1927 | Plum |
| 1,794,898 | A | 3/1931 | Hillmann |
| 3,111,695 | A | 11/1963 | Kelly, Jr. |
| 3,149,351 | A | 9/1964 | Plum |

(Continued)

FOREIGN PATENT DOCUMENTS

| | | |
|---|---|---|
| DE | 4332216 A1 | 6/1994 |
| EP | 0 059 345 | 9/1982 |

(Continued)

OTHER PUBLICATIONS

"Hydrofoil Handbook vol. II, Hydrodynamic Characteristics of Components", OTS—US Department of Commerce, 1954.

(Continued)

*Primary Examiner* — Andrew Polay
(74) *Attorney, Agent, or Firm* — W & C IP

(57) ABSTRACT

Watercraft hulls and parts thereof are disclosed which improve hydrodynamic performance for yachts, sailboards, and other craft. Drag at the transition from displacement mode to planing mode may be reduced to be the same or less than the minimum drag experienced in planing mode. Exemplary embodiments may include a bow with a center planing surface and tunnels to either side. The bow tunnels may each end in a step. At least part of the center planing surface may be cambered. A spoiler and/or interceptor may be provided at an aft end of a camber of a planing surface. For some hulls, the bow is followed by a main lift surface which is followed by a back lift surface (from stem to stern). In the back lift surface behind the main lift surface, a tunnel surface may be provided to add longitudinal stability.

17 Claims, 14 Drawing Sheets

(56) References Cited

U.S. PATENT DOCUMENTS

| | | | | |
|---|---|---|---|---|
| 3,274,966 | A | 9/1966 | Rethorst | |
| 3,495,563 | A | 2/1970 | Reischmann | |
| 3,709,179 | A | 1/1973 | Payne | |
| 3,747,138 | A | 7/1973 | Morgan | |
| 3,763,810 | A | 10/1973 | Payne | |
| 3,802,370 | A | 4/1974 | Collier | |
| 4,002,131 | A | 1/1977 | Mangrum | |
| 4,058,077 | A | 11/1977 | Johansson | |
| 4,083,320 | A | 4/1978 | Yost | |
| 4,592,734 | A | 6/1986 | Metiver | |
| 4,629,435 | A | 12/1986 | Pitcairn | |
| 4,649,851 | A | 3/1987 | April | |
| 4,748,929 | A | 6/1988 | Payne | |
| 4,843,988 | A | 7/1989 | Clement | |
| 4,915,048 | A | 4/1990 | Stanford | |
| 4,924,742 | A | 5/1990 | Numata et al. | |
| 5,191,853 | A | 3/1993 | Adler | |
| 5,456,202 | A | 10/1995 | Schoell | |
| 5,471,942 | A | 12/1995 | Miller et al. | |
| 5,520,130 | A | 5/1996 | Upchurch | |
| 5,582,123 | A | 12/1996 | Rethorst | |
| 5,588,389 | A | 12/1996 | Carter, Jr. | |
| 6,138,601 | A | 10/2000 | Anderson et al. | |
| 6,138,602 | A | 10/2000 | Cary | |
| 6,595,151 | B2 | 7/2003 | Keller | |
| 6,935,909 | B2 | 8/2005 | Mann | |
| 7,144,285 | B1 | 12/2006 | Hendricks | |
| 7,165,503 | B2 * | 1/2007 | Mascellaro | B63B 1/20 114/290 |
| 7,418,915 | B2 * | 9/2008 | Campbell | B63B 1/20 114/288 |
| 7,793,604 | B2 | 9/2010 | Keller | |
| 7,845,302 | B2 | 12/2010 | Loui et al. | |
| 8,122,840 | B2 | 2/2012 | Harper | |
| 8,622,013 | B2 | 1/2014 | Keller | |
| 9,038,561 | B2 * | 5/2015 | Loui | B63B 1/042 114/291 |
| 9,242,699 | B2 | 1/2016 | Keller | |
| 10,086,908 | B2 * | 10/2018 | Kato | B63B 1/042 |
| 10,293,886 | B2 * | 5/2019 | Bjersten | B63B 1/18 |
| 2002/0178984 | A1 | 12/2002 | Keller | |
| 2003/0003825 | A1 | 1/2003 | Keller | |
| 2005/0199173 | A1 | 9/2005 | Smith | |
| 2007/0259579 | A1 | 11/2007 | Schmidt | |
| 2008/0311806 | A1 | 12/2008 | Mead | |
| 2010/0000455 | A1 | 1/2010 | Harper | |

FOREIGN PATENT DOCUMENTS

| | | |
|---|---|---|
| GB | 191310801 A | 2/1914 |
| WO | 95/23087 | 8/1995 |
| WO | 2010/033579 | 3/2010 |
| WO | 2010/115106 | 10/2010 |
| WO | 2011-117906 | 9/2011 |

OTHER PUBLICATIONS

D. Savitsky; "Hydrodynamic Design of Planing Hulls"; Marine Technology, vol. 1, No. 1, Oct. 1964, pp. 71-95.

E. P. Clement; "A Configuration for a Stepped Planing Boat Having Minimum Drag (Dynaplane Boat)"; International Hydrofoil Society, Nov. 11, 2005, entire design paper.

Johnson, Jr.; "Theoretical and Experimental Investigation of Supercavitating Hydrofoils Operating Near the Free Water Surface"; NASA Tech. Report R-93, 1961, pp. 1-78.

W. Sottorf, Experiments with Planing Surfaces, National Advisory Committee for Aeronautics, Technical Memorandum No. 739, Mar. 1934, p. 19-22.

Blount, D.L. and Codega, L.T., Dynamic Stability of Planing Boats. Marine Technology, vol. 29, No. 1, Jan. 1992, p. 4-12.

* cited by examiner

ADVANCES IN WATERCRAFT HULL LIFT, EFFICIENCY, AND REDUCED HUMP DRAG WITH INCREASED STABILITY

CROSS-REFERENCE TO RELATED APPLICATIONS

This application claims the benefit of U.S. provisional patent application No. 62/551,478, filed Aug. 29, 2017, the complete contents of which are herein incorporated by reference.

FIELD OF THE INVENTION

The present invention generally relates to hull designs for watercraft capable of planing such as but not limited to power boats (including speed boats and yachts), surfboards, sailboards, standup paddle (SUP) boards, kiteboards, and wakeboards.

BACKGROUND

Some watercraft are designed to operate in a planing mode as well as in a displacement mode along with semi-planing or transition in between displacement and planing. In displacement mode the lift is from displacement of water. As speed increases this force decreases due to the Bernoulli effect. In planing mode the lift is derived from a downward deflection of water by the shape of the hull. In transition there is often considerable wave and turbulence drag.

SUMMARY

An objective of hull design is to reduce the drag at transition speed and at low planing speed, also called the "hump drag", since it is often larger than the drag at higher speeds. An example hull which reduces some hump drag compared to preexisting hulls is disclosed in U.S. Pat. No. 9,242,699 B2 by the same inventor as the instant invention. U.S. Pat. No. 9,242,699 B2 is incorporated herein by reference.

In an exemplary embodiment, a watercraft hull includes a front lift surface comprising or consisting of a center surface and two tunnels cut into the outside bottom surface. The center surface may have a (nonzero) deadrise angle, and the width or beam of the front lift surface may be determined by the sum of the width of the center surface and widths of the two tunnels cut into the outside bottom.

The tunnels to the port and starboard sides (to the left and right sides) of the center surface may have varying depth and width and a sharp chine/spray deflector at the junctions between the tunnel and the center planing surface. At high speeds, these tunnels/chines generally determine the outer edge of the wetted surface. At low speeds the tunnels generally determine the outer edge of the wetted surface.

According to an aspect of some embodiments, the tunnels end in a step in height and/or planing angle near the back of the front lift surface (see U.S. Pat. No. 8,622,013 B2 by the same inventor for some exemplary steps; U.S. Pat. No. 8,622,013 B2 is herein incorporated by reference). The configuration of the front surface, tunnels, and steps may achieve multiple objectives. Besides producing front lift, exemplary embodiments may also slice through smaller waves while the tunnel/step and center surface provide lift to lift the bow in large waves. Since the tunnels are cut deeper into the board and generally have a larger attack angle they 1) form the out edge of the center (planing) surface in flat water and small waves, 2) make the breadth of this planing surface smaller such that the bow can slice through flat and small waves, and 3) for larger waves, or if the sailor's weight is too far forward on a sailboard, fill with water and together with the center surface will lift the front of the hull over most waves and keep the bow from being breeched. All these effects cause this bow design to have less drag in flat water, small waves, and larger waves. However, the tunnels narrow the overall front planing surface so as to give a smoother ride by both slicing through smaller waves and reducing the total heave acceleration in large waves. The tunnels may be configured to limit both the total wetted surface of the front lift surface (e.g., limit the total wetted surface of the hull's bow) and the wave drag of the front lift surface. Reducing the wetted surface and wave drag of the front lift surface reduces the wetted surface, wave drag, and friction drag of the hull as a whole.

The tunnels may end within 15% of the boat length from the back of the front planing surface. In other words, each step's location measured along a longitudinal direction of the hull is 0 to 15% of the hull length either fore or aft of a location of the center planing surface's aft end. At high speed the steps dewet a region of hull behind the steps. The steps may be configured to direct the wake off of the steps partially or entirely outside of the high lift surface (main plaining surface). This has the desired result that at high speed the main lift surface does not fall into the wake from steps at the end of the bow tunnels.

Both for sailboards and yachts, the bow's tunnels may assist in lifting the watercraft up over waves and allow the watercraft to have a wider bow profile and higher average attack angle in waves while having a narrower nose and smaller attack angle in flatter water.

According to another aspect, some embodiment increase the length of the front planing surface to displacement volume ratio of the front planing surface and also reduce its beam "b" by placing short tunnels outside of the front planing surface.

According to another aspect, hulls of some embodiments are configured to increase the lift of the planing surfaces while keeping the ratio of lift to drag roughly the same as configurations with lower lift. This may be achieved with, for example, a spoiler/angled interceptor and step in planing angle at the back end of the planing surface such as a Johnson camber configuration (3 term, 5 term) or higher order configurations.

According to another aspect, some embodiments increase the longitudinal stability of a hull with the addition of a single-deadrise tunneled demi-hulls surface after the main planing surface (i.e., high lift surface). By "single-deadrise tunneled demi-hulls" what is meant is single hull split into two halves and separated by a tunnel surface in the middle. To either side of the tunnel surface the "hull halves" or "demi-dulls" may have a single deadrise angle, multiple deadrise angles, one or more stakes, and/or a curved (non-linear) profile in the transverse direction. A vertical or nearly vertical surface behind the main planing surface is supplied by the tunnel surface, and it is the vertical or nearly vertical surface that is responsible for increasing the hulls longitudinal stability.

In some embodiments, a hull according to the present invention reduces resistance in the 20-30 mph range, even to the point where a "hump" in the drag characterization is lower than the minimum drag in planing mode.

For yachts an exemplary tunnel bow limits the decrease of the planing angle and limits the high speed planing wetted surface and thus decrease the high-speed planing drag essentially to that of three points (one in the front and two in the back of the yacht).

To reduce hump drag, some embodiments increase both the length to displacement and the length to beam near the front lift surface.

In some embodiments, planing drag is decreased by increasing a hull's "length over displacement", L/ΔD, where D is displacement. The same or other embodiments further decrease the planing drag by increasing the length over breadth width, L/B.

BRIEF DESCRIPTION OF THE DRAWINGS

The foregoing and other objects, aspects, and advantages will be better understood from the following, in which.

DETAILED DESCRIPTION

Exemplary embodiments of the invention involve watercraft hulls, surfaces of watercraft hulls, and general hull configurations. In particular, exemplary embodiments involve surfaces which face or contact the water during at least some states of use. Exemplary embodiments use a combination of surfaces and surface features to create advantageous hydrodynamic effects for exemplary performance in displacement mode, planing mode, and/or the transition mode between displacement and planing.

For the purposes of this disclosure, "planing mode" is generally defined as the lift being mainly hydrodynamic lift (≥90%) and when the hydrostatic lift is ≤10% of the total lift. "Displacement mode" is generally where the lift is mainly hydrostatic and the drag vs. speed is increasing nonlinearly with increasing speed. As used herein, "displacement mode" is used to indicate that ≥70% of the lift is hydrostatic lift and the remaining lift (≈30% or less) is hydrodynamic lift. Thus the board or watercraft hull is in "transition mode" when the hydrostatic lift is between 70% and 10% of the total lift and the hydrodynamic lift is most of the remaining lift, that is, 30% to 90%. In "transition mode", the drag vs. speed normally goes through a hump or peak, but this is not always the case if the weight is small or the wave drag is sufficiently reduced. The hump in drag may occur because during the transition mode, the hull begins to plane but the hull is not yet at an optimal planing angle. In addition, wave drag may be present in transitional mode that disappears once the hull is in planing mode.

The main drag forces for a hull in planing mode are the dynamic drag, which is the dynamic force in the backward direction, and the skin friction. The main drag force in displacement mode is wave drag, which is the difference of pressure on forward facing surfaces and backward facing surfaces. In transition mode, all three—dynamic drag, skin friction, and wave drag—are important, with wave drag and dynamic drag being the most important.

Some exemplary embodiments may operate in planing mode for speeds such as 8-25 mph or more for sailboards, 12-80 mph or more for power boats, and 12-35 or more for large yachts. The particular speed ranges differs some from one watercraft type to another. Generally, reducing or eliminating hump drag can result in a hull planing at lower speeds.

Figure 4:
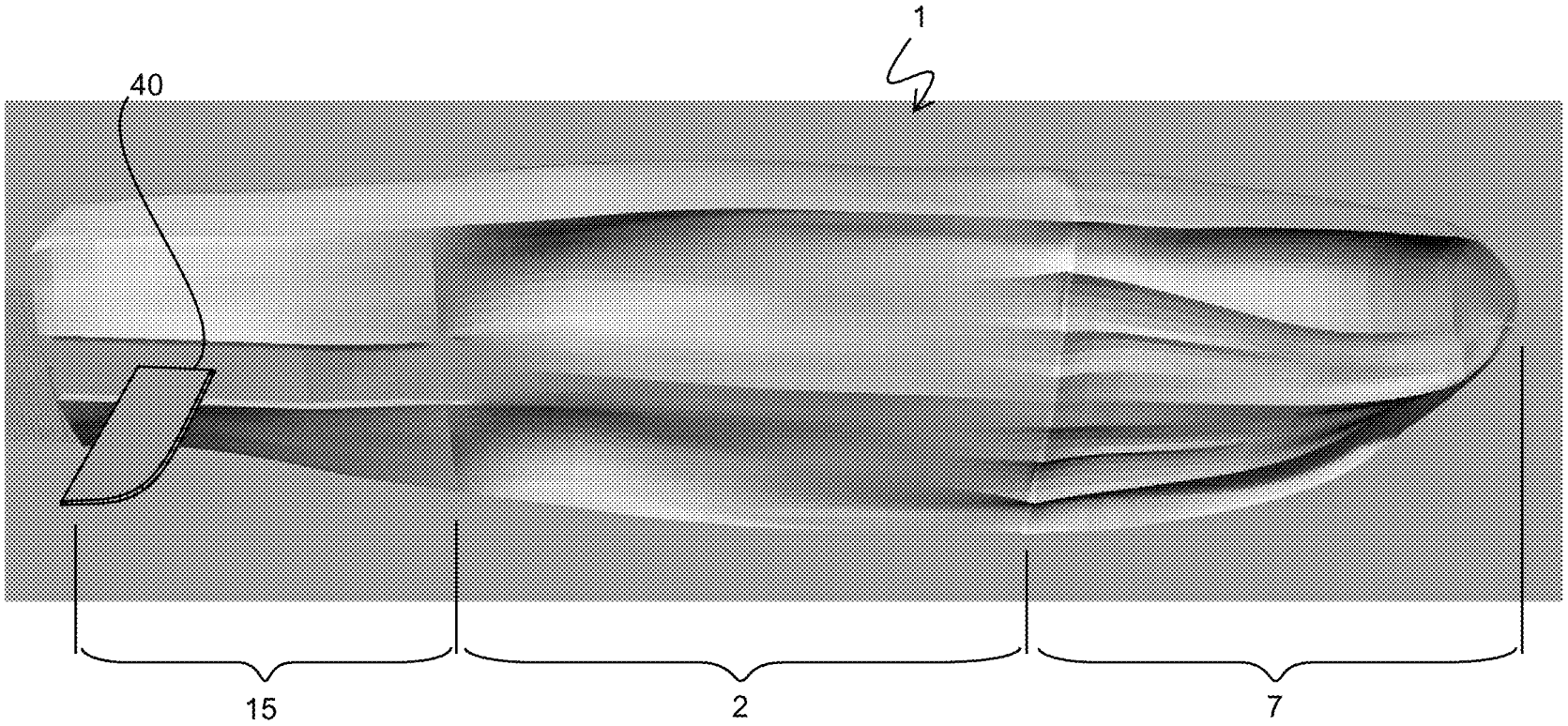
FIG. 4 is a perspective view of the bottom of a whole hull, stem to stern.

FIG. 4 is a perspective view showing the full bottom of a hull 1, from stem to stern (that is, from the frontmost point to the rearmost point). As used herein, "stem to stern" refers to the front most part of the hull to the rearmost part of the hull, that is from one end of a watercraft to the other. A watercraft need not have a specific structure identifiable as a "stem" for the expression "stem to stern" to be used. General synonyms of "stem to stern" include "bow to stern" or "prow to stern". However, since "bow" is used in this disclosure to refer to a region of the boat (e.g., a front region which may, for example, make up approximately 30% of the hull) the expression "stem to stern" will be favored when referring to the absolute ends of the hull (e.g., definable by a point, line, or plane).

The hull 1 may be that of a sailboard or yacht, for example. Generally the hull 1 may be of any watercraft capable of planing, for example yachts or sailboards. However, embodiments of the invention may also benefit the performance of non-planing watercraft such as standup paddle (SUP) boards, among others. Therefore an exemplary hull 1 may be configured for a watercraft such as but not limited to power boats (including speed boats and yachts), surfboards, sailboards, standup paddle (SUP) boards, kiteboards, and wakeboards. The bottom of the hull 1 has at least three identifiable regions, and the bottom of the hull may either comprise or consist of these three regions together. From stem to stern, these are a front lift surface 7, a main lift surface 2, and a back lift surface 15. As used herein, these terms refer to regions of the hull bottom, and thus may be alternatively called front region 7, middle region 2, and back region 15 if desired. As a shorthand, these surfaces or regions are referred to herein as S7, S2, and S15, respectively. Other surfaces may be similarly abbreviated (e.g., a "surface 99" or "region 99" may be referred to simply as "S99"). As evident from FIG. 4, each of S7, S2, and S15 may individually comprise a plurality of different features and (sub)surfaces. Generally, a surface may be referred to as a "lift surface" if at least part of the surface is acted upon by water to supply lift to the hull under least some operating conditions (e.g., at one or more speeds or speed ranges, or when exposed to certain types of waves). Sometimes a "lift surface" may be characterized as a "planing surface," which simply implies that the surface may supply lift to the watercraft when the craft is in planing mode.

Boundaries between regions, surfaces, and features of the hull may be defined by any of a number of different elements, such as but not limited to: a step or steps in depth or planing angle, a change in concavity, a ridge, a change in deadrise (i.e., deadrise angle), chine, spray deflector, waterline, a change in attack angle (e.g., a sharp point, a change in attack angle at which the derivative is undefined, where the limits approaching the point of change in attack angle are not the same), the keel, the keel area, and a boundary between wetted and unwetted surfaces/regions. As is known in the art, some hull features may smoothly transition from one to the next and therefore may lack a definable "line" or similar absolute boundary. In such cases adjacent features may still be separately identifiable though a precise boundary between the adjacent features cannot be pinpointed owing to the nature of hull design.

The "transverse direction" generally means the shortest path from the starboard side of a hull to the port side of the hull, or vice versa. Unless the context indicates otherwise, exemplary embodiments described herein are generally symmetrical in the transverse direction of the hull. In other words, the hull's geometry (especially at the bottom side of the hull facing or facing into the water) is mirrored on either side of a center longitudinal plane bisecting the hull into equal parts port side and starboard side. The "keel line" is a known term in the art and is a geometric line (or curve) tracking the center and/or bottommost edge of the keel. Regardless of where the keel begins or ends the geometric "keel line" may extend from one longitudinal end of the hull to the opposite longitudinal end of the hull (i.e., from stem to stern). The keel line generally lies in the geometric plane bisecting the hull into equal parts port side and starboard side. A "width" or "breadth" is generally measured in the transverse direction. Conversely, a "length" is generally measured in the longitudinal direction.

In some exemplary embodiments, a watercraft hull comprises a main lift surface 2 and a back lift surface 15 according to what is disclosed in U.S. Pat. No. 9,242,699 B2, the complete contents of which are herein incorporated by reference. To facilitate comparison, some of the reference labels in this disclosure have been deliberately made to match reference labels in the '699 patent. However, the common reference labels are for ease of comparison only and are not intended to imply that all features in the '699 patent correspond exactly with the features of the instant disclosure where reference labels match. Rather, they may match in some embodiments but do not necessarily match. In particular, in many exemplary embodiments according to the present invention, the front lift surface 7 differs significantly from what is disclosed in U.S. Pat. No. 9,242,699. S7 of exemplary embodiments will now be discussed in detail.

Figure 1A:
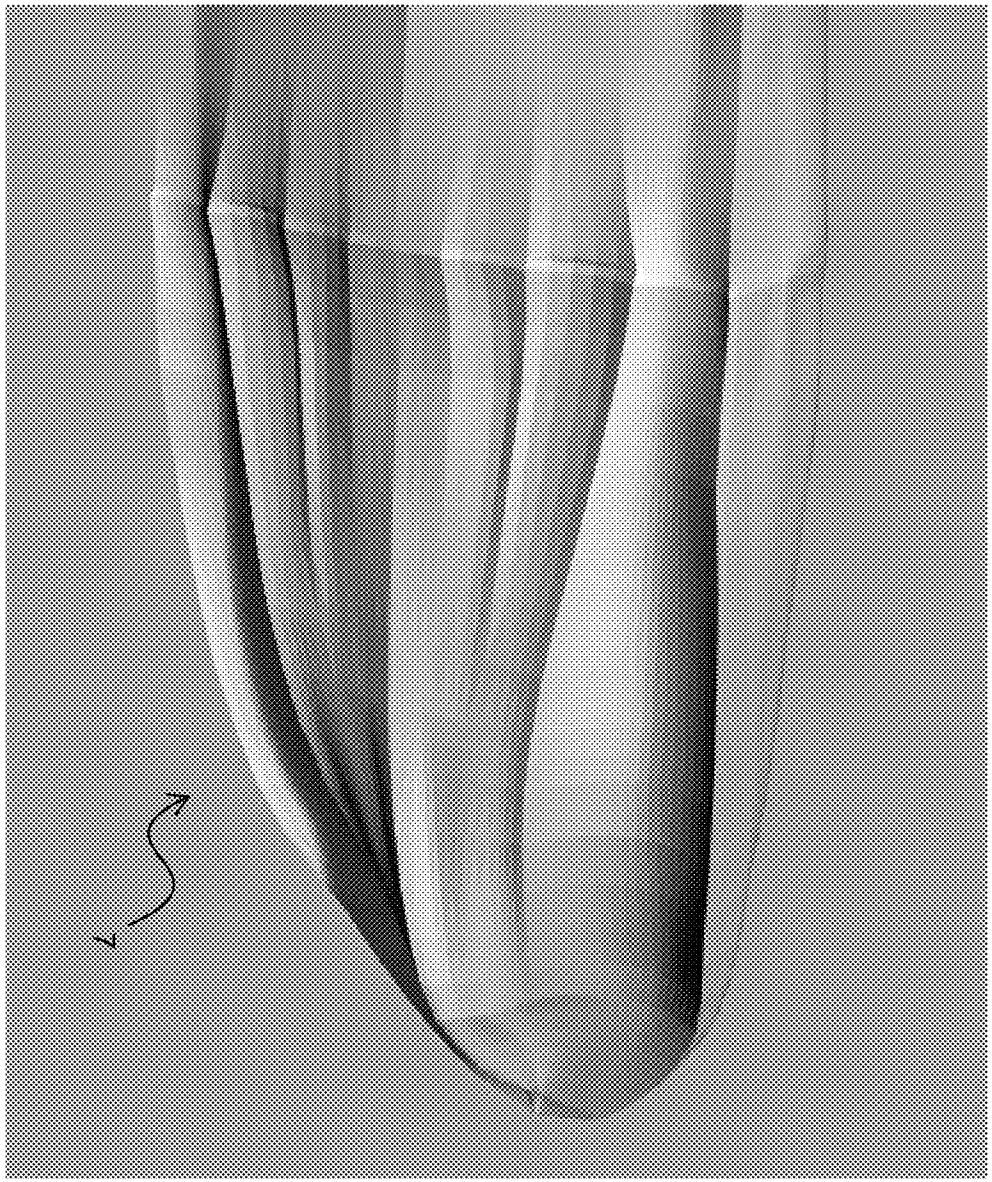
FIGS. 1A to 1G are a bottom perspective view of the front lift surface or bow of a hull.
Figure 1B:
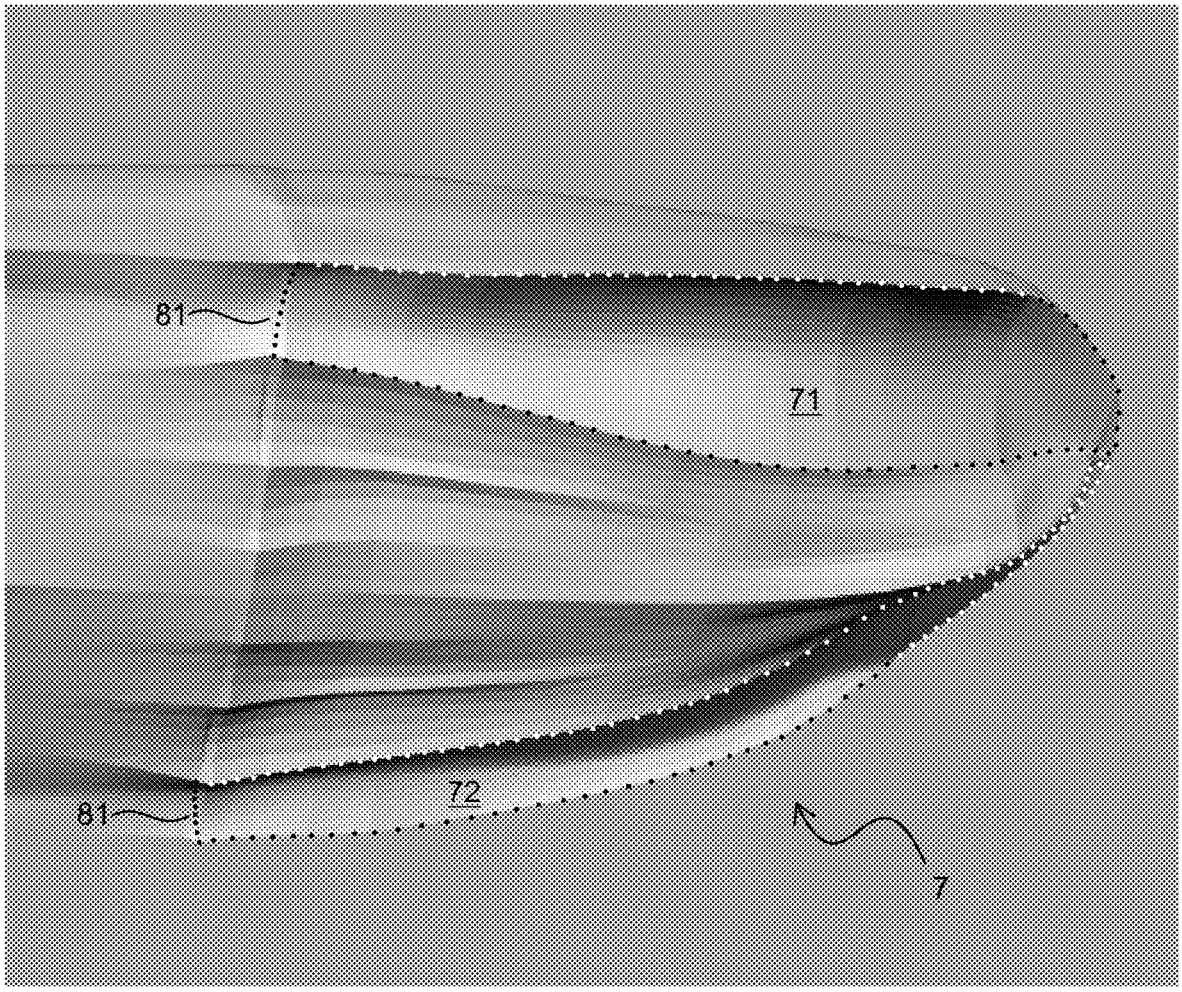
Figure 1C:
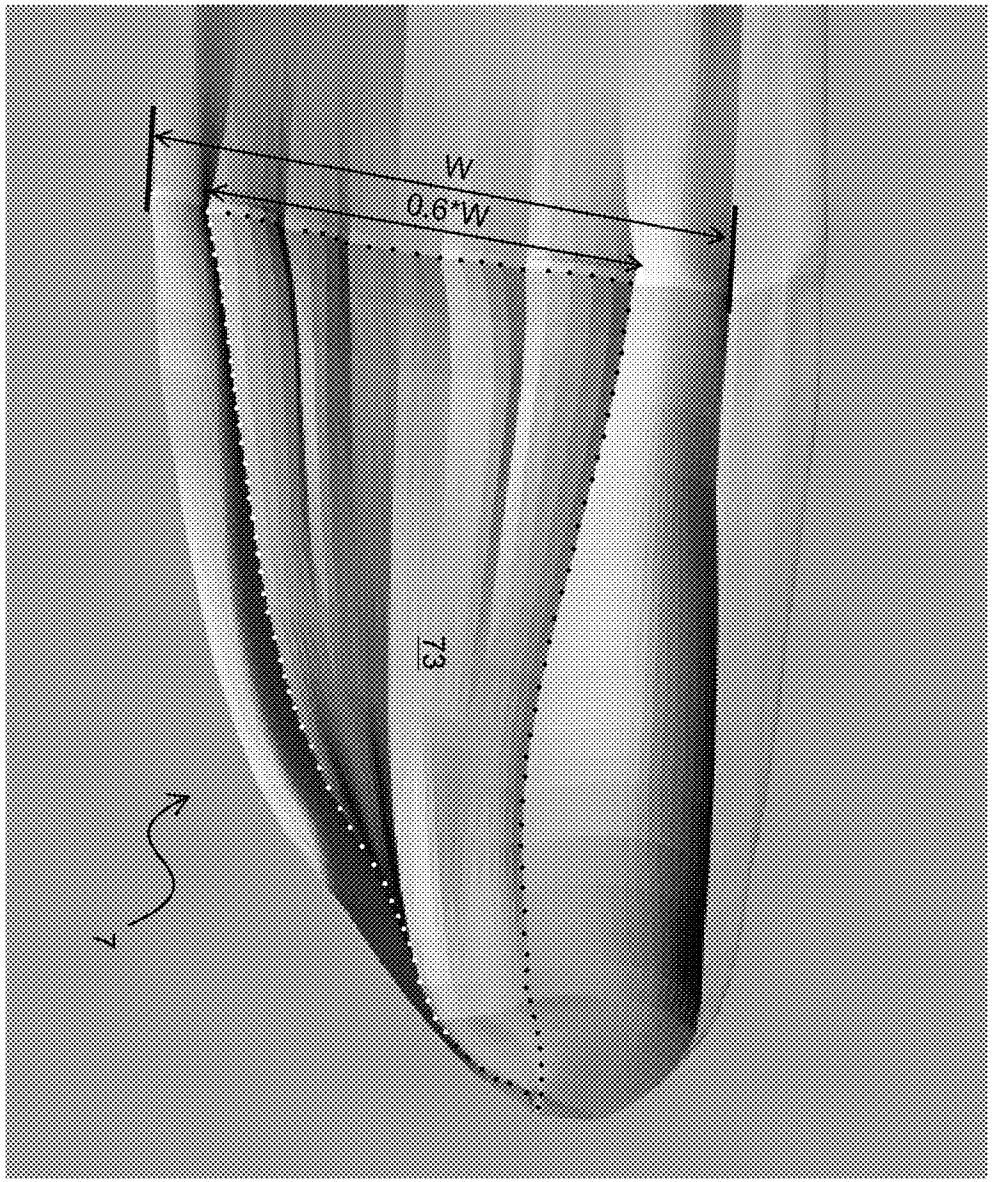

FIG. 1A shows a bottom perspective view of the front lift surface 7 ("S7"). The front lift surface 7 comprises outer tunnels 71 and 72 (see FIG. 1B) which limit the center surface 73 ("S73", see FIG. 1C) of S7 to about 60% of the total breadth W at that part of the longitudinal length of the hull where S7 ends (and S2 begins). Note that herein, S73 may sometimes be referred to as the "bow prism". Fore of the longitudinal point where S7 ends the breadth of S73 is even less, e.g., less than 60%. The breadth of S73 may reduce from aft to fore for the entire length of S73. This is visually apparent in FIG. 1C. The configuration of S73 reduces the drag at lower planing speeds, including at speeds where hump drag is traditionally experienced.

Figure 1D:
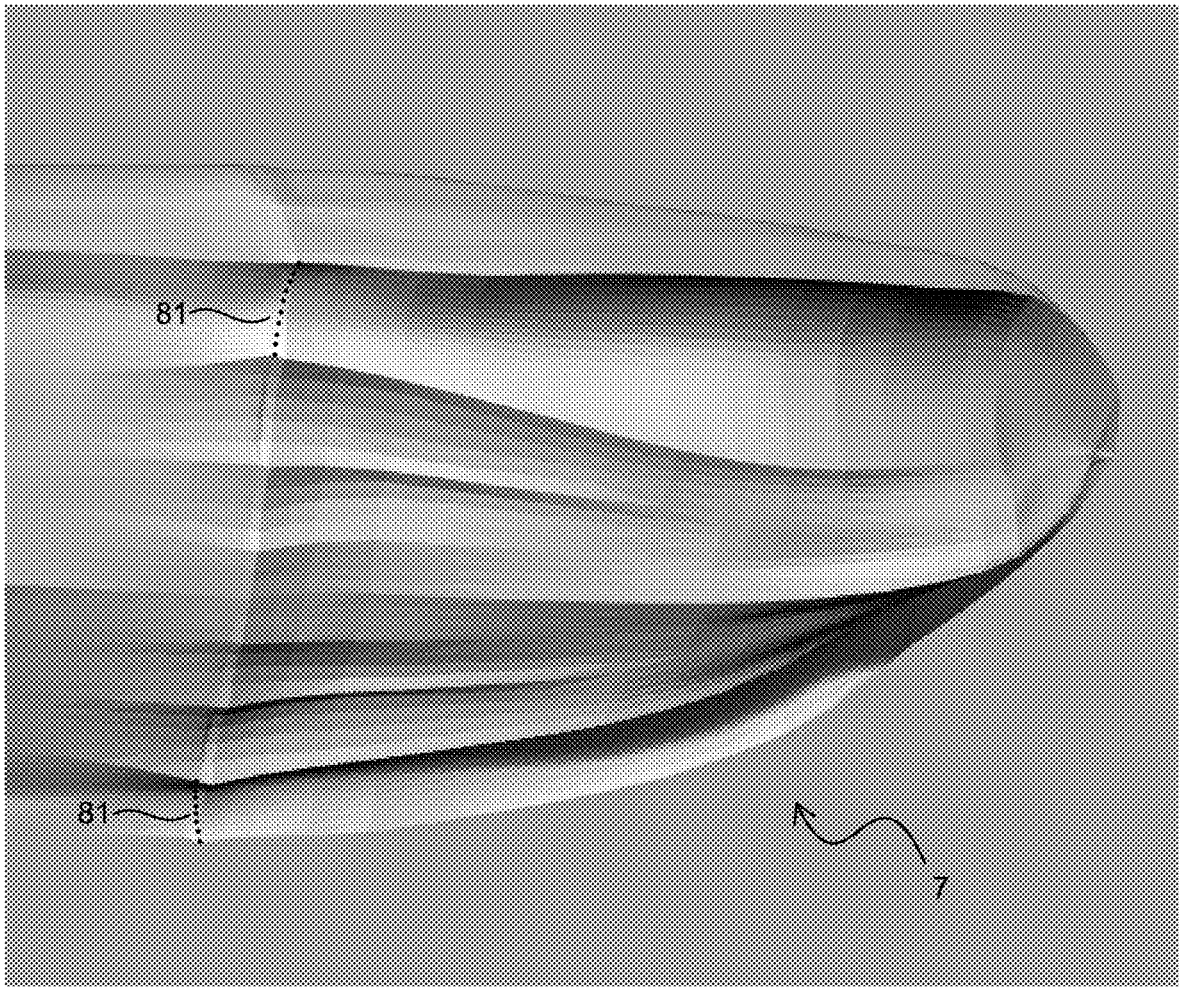
Figure 1E:
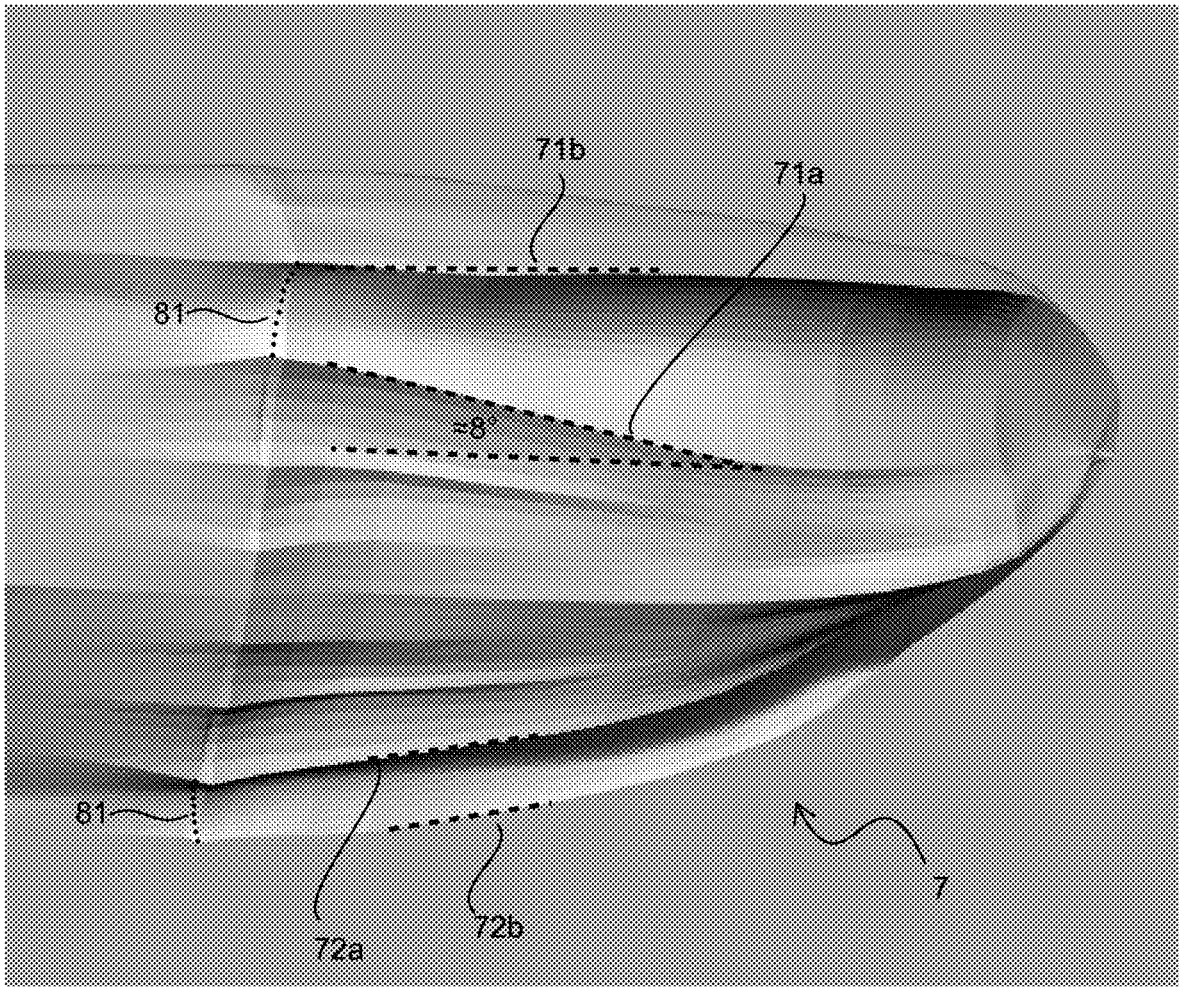
Figure 1F:
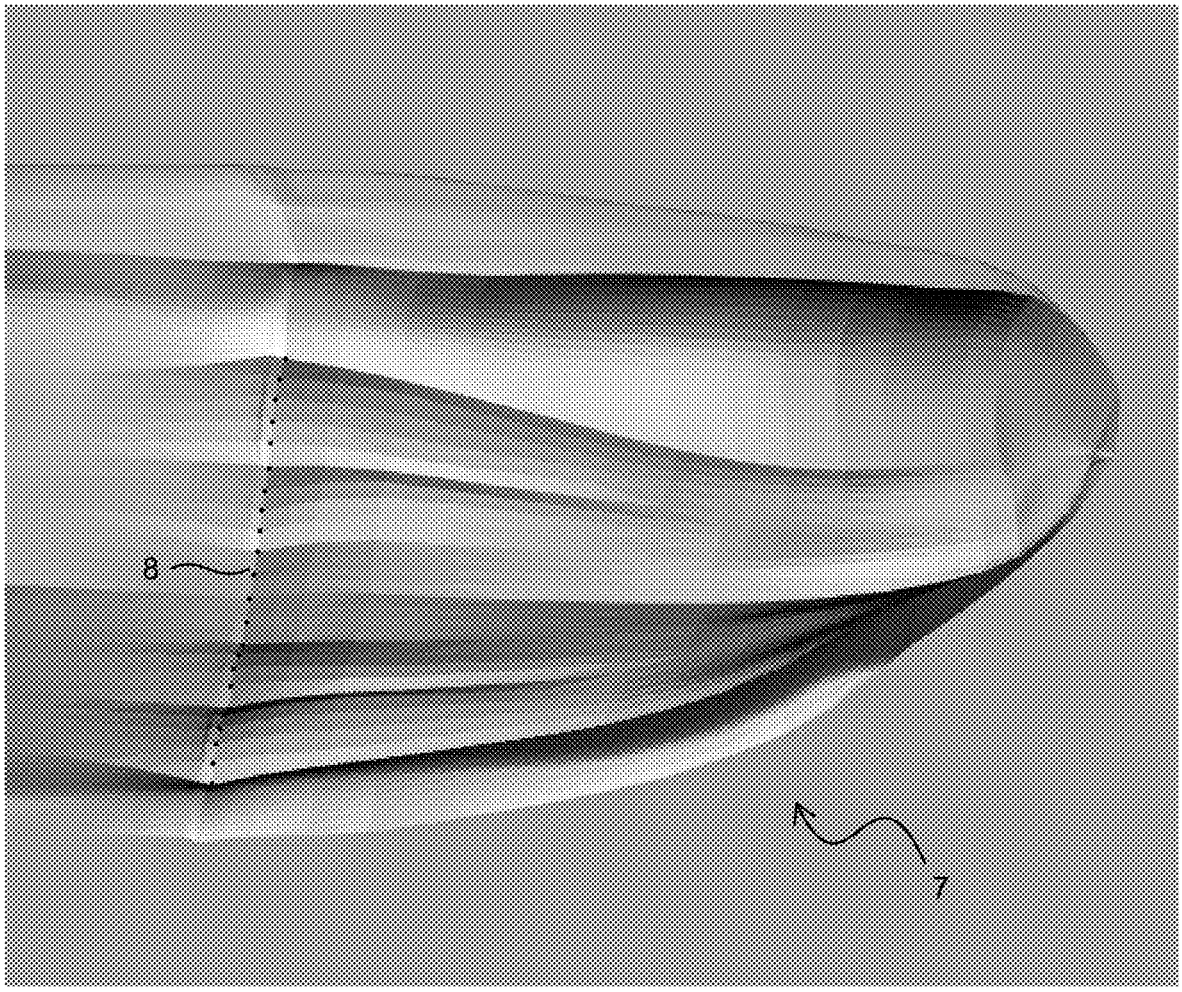

For yacht hulls, the bow planing prism (that is, S73) can have a step/camber 8 which dewets the front of the main lift surface 2, particularly at high planing speeds (see FIG. 1F). A step 8 is not needed for the sailboards as the sailor moves back into the foot straps at high planing speeds, thereby changing the longitudinal center of mass of the combined board+operator system. For yachts a narrow bow according to an exemplary embodiment of the invention allows the yacht to smoothly go through small waves while the tunnel/steps allow the bow of the yacht to ride up over larger waves.

The tunnels 71 and 72, one to either side of the S73, may each end in a step 81 in depth or planing angle (see FIG. 1D, with curves tracing the edges of steps 81). The steps 81 are each positioned at a longitudinal position of the hull equal to the longitudinal position of the aft end of S73±15% of the total hull length (measured stem to stern). At faster planing speeds the wake off of the steps 81 will be at least partially outside of the main lift surface 2 ("S2"). In that way it reduces the possibility of the back lift surface 15 or the main lift surface 2 falling into the wake off of steps 8 or 81, which would adversely affect the hull planing angle.

A bow comprising or consisting of S7 is well suited for large watercraft hulls like yachts and smaller watercraft hulls like sailboards. However, some differences may be provided based on the intended use. Sailboards comprise a fin attached to or integral with S2/S15 (see, e.g., outline of fin 40 in FIG. 4). For sailboards, it is desirable that the sailboard fin be presented with clean water during use. Meaning, the board should be configured so that no part fore of the fin causes a wake or significant turbulence in water which reaches the fin. Accordingly a step 81 is presented at the end of each tunnel 71 and 72, but no such step 81 is presented at the aft end of the S73 thus leaving clean water for the sailboard fin (which is aft of S73). For a yacht hull and similar craft, however, a step 8 (see FIG. 1F) may be provided after the aft end of S73 in addition to the steps 81 at the aft ends of the two outside tunnels 71 and 72. By dewetted certain regions of the watercraft behind the bow, the drag at high speeds is reduced. The resulting configurations for both types of watercraft is a smooth ride in small waves and the ability to raise up over bigger waves.

The tunnels 71 and 72 may be separated from S73 by a sharp chine/spray deflector at the junctions where the tunnels meet S73. The sharp chine edge of S73 may be configured to deflect spray off of S73 downward (i.e., away from the hull).

Figure 1G:
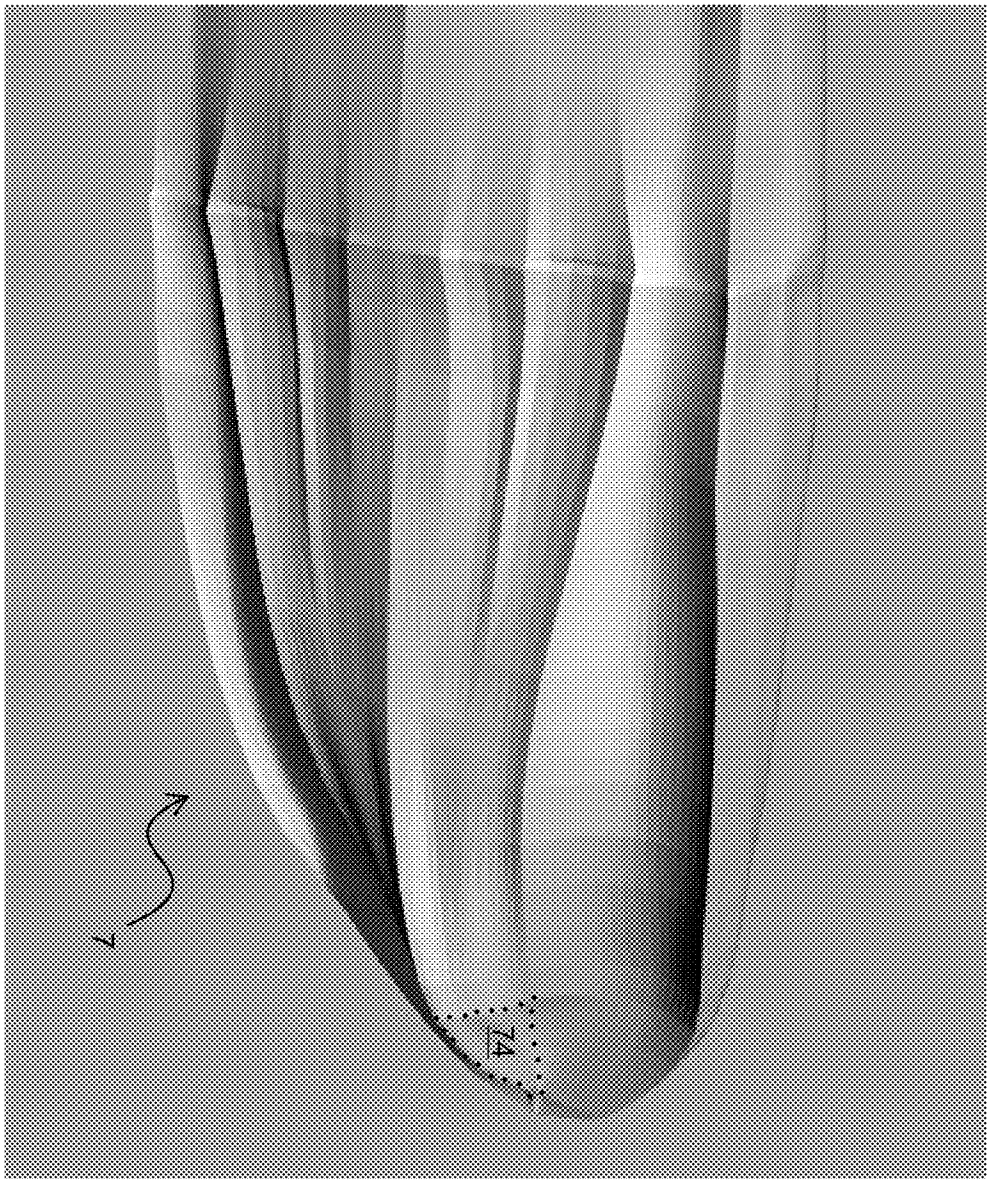

The relatively narrow and pointed planing surface supplied by S73 in the front of the hull 1 allows the bow to efficiently slice through waves, producing a smooth ride. Meanwhile, the outside tunnels 71 and 72 prevent the bow from being broached when big waves are encountered. The nose or front 74 (see FIG. 1G) of S73 may be parabolic or hyperbolic in a transverse direction. "Prism coefficient" is a term of art•and may be calculated as the cubic displacement volume/midsection area*wetted water length. The prism coefficient of the nose 74 may vary among embodiments, depending on the top speed(s) the hull 1 is intended to reach by virtue of its intended use. For example, sailboards and yachts can each benefit from the invention, but the exact metrics of the features will vary since these two types of watercraft may be intended to travel at considerably different top speeds. Whatever the type of watercraft hull, minimizing drag and the hump drag between displacement mode and planing mode is desirable and achievable with configurations herein described. In general, the prism coefficient of the nose 74 of the hull 1 will be wider at higher design speeds as compared to lower design speeds, for example 0.6 to 0.7 for planing or near planing conditions.

When sailing a sailboard, the operator (i.e., the sailor) wants it to plane. To plane it is desirable that the sailboard be at a low angle of attack so it has less drag. Ordinarily the operator attempts to push the board forward with his feet or by pumping to get the board to move faster than the hump speed (where there is a spike in drag between the displacement mode and the planing mode). Once the board is planing, the drag reduces below the hump drag and the board is able to maintain a speed and stay planing. After the board is planing, it is generally desirable that the planing angle of attack is about 4.3 to 5.5 degrees or smaller for rockered/cambered surfaces. To achieve this, embodiments herein may provide a lighter bow to the board.

To reduce the hump drag and preferably eliminate the hump drag (e.g., making the drag in transition mode equal to or less than the minimum drag in planing mode), embodiments may minimize the watercraft displacement (generally equaling the total weight of the craft and the load) divided by the craft length. In addition, to reduce or eliminate the hump drag embodiments may minimize the beam width/hull length. The inventor has discovered that the latter feature may be used not just in the hull as a whole but also specifically for the bow of the hull. That is, hump drag may be reduced or eliminated by minimizing the ratio of bow beam of S73/bow length. The bow beam is an important width to consider and is preferably kept small.

The tunnels 71 and 72 may be angled outward, e.g. at 8 degrees, so that any wake from the steps 81 only dewet outside regions of the board or yacht in the region of the hull behind the bow. Step 81 may be angled so that the outside of 81 is forward of the inside e.g. 5 degrees. The steps 81 may be angled with respect to the transverse direction of the hull, as apparent in FIG. 1D. The step 81 may reach the side of the hull at a position fore of where step 81 reaches S73 or S2. A step 81 may form an angle with respect to the transverse direction of, for example, 5 degrees. FIG. 1E illustrates the outward angle of approximately 8 degrees of the tunnels. Said differently, the centermost longitudinal edge 71*a* or 72*a* of a tunnel 71 or 72 (the edge adjacent to the center 73) may progressively move closer to the outside edge 71*b* or 72*b* in the aft direction. As a result, the width (i.e., the transverse distance) of the tunnel 71 or 72 is comparatively greater closer to the stem and smaller closer to the stern. As a result of this configuration, the tunnels 71 and 72 do not put air into the water which can go by the fin (if the board is a sailboard) and cause ventilation of the fin. The tunnels also do not reduce the lift of the lift of the step behind the main planing surface/step.

Figure 2A:
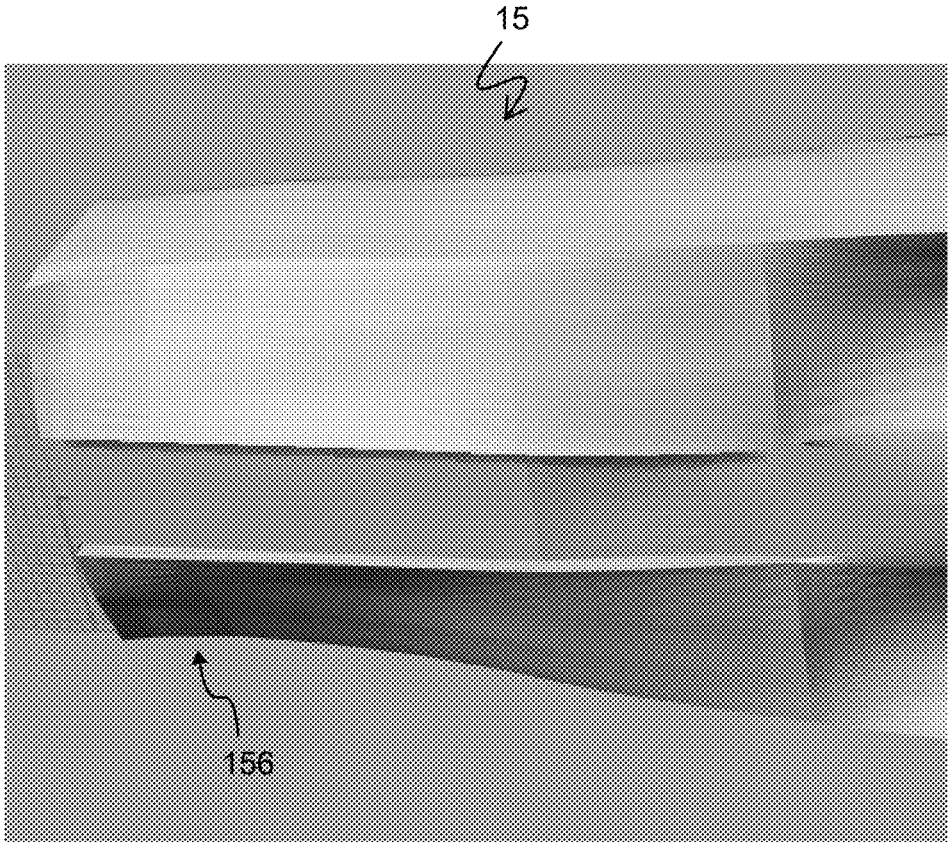
FIGS. 2A to 2C are a perspective view of a back lift surface of a hull that includes a tunnel surface behind a main lift surface for added longitudinal stability.
Figure 2B:
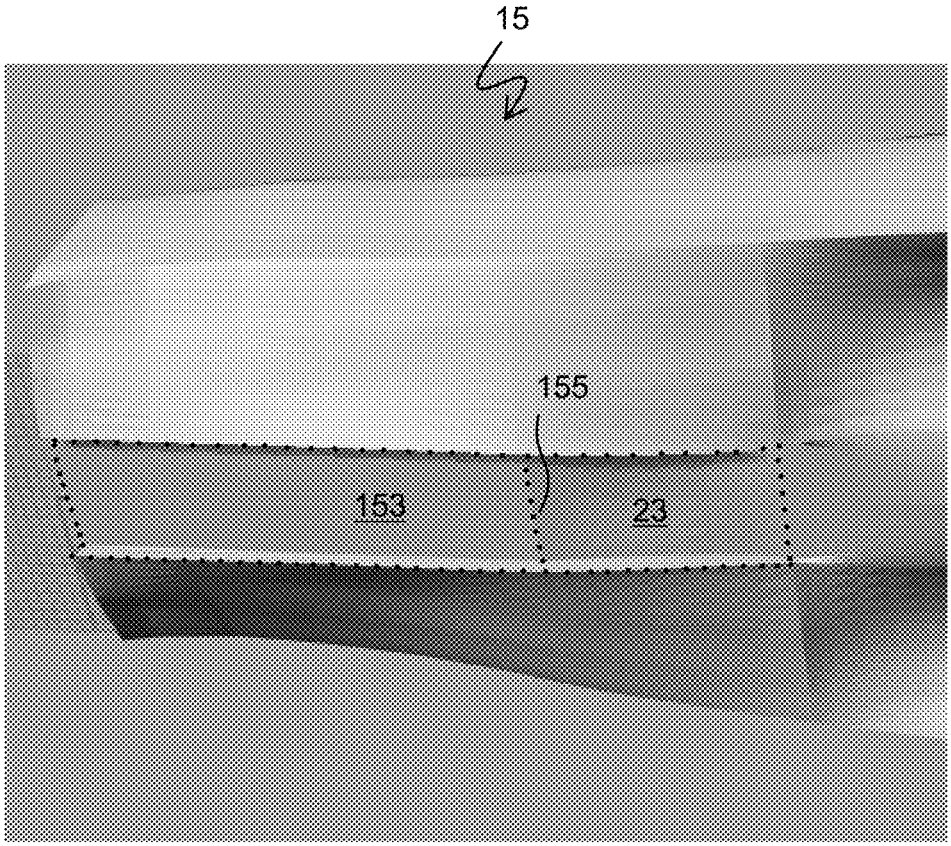

FIG. 2A shows a perspective view of the back lift surface or region, S15 (see also FIG. 4). In FIG. 2A one can see a spoiler curve 156 at a back outside of S15. FIG. 2B identifies the tunnel surface 153 of S15. FIG. 2B also shows an extension 23 of the center of S2 which reaches into S15. S23 and S153 are separated by a step 155 in angle. The tunnel surface 153 is behind the main lift surface 2 (see FIG. 4) and is provided to add longitudinal stability to the board.

Figure 2C:
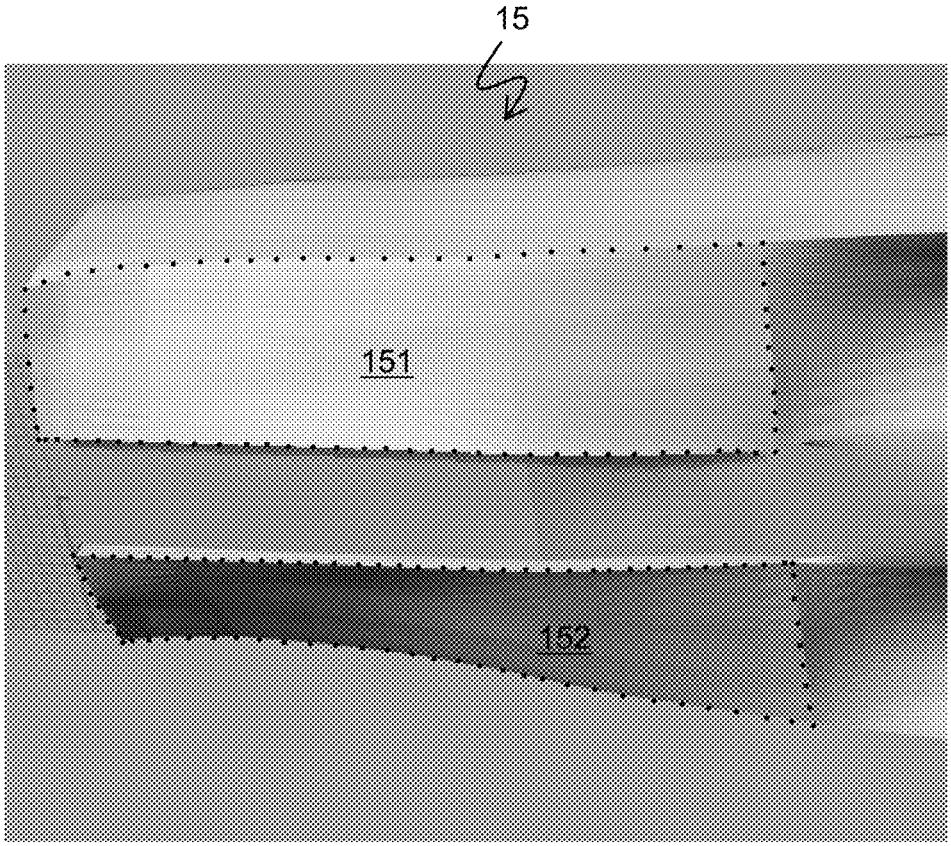

The tunnel surface 153 may be centered in the transverse direction of the board, keeping the board symmetrical in the transverse direction. The tunnel surface 153 adds to the lateral resistance, thus reducing or eliminating one of the biggest downsides of a stepped planing hull. The back lift surface 15 generally has a single deadrise angle on each outer side, that is to say to each side of the tunnel surface 153. These regions 151 and 152 are identified in FIG. 2C. S151 and S152 may be demi-hulls with a vertical or very steep side angle on the inside such that the angled edge digs into the water if the back of the hull attempts to move in the transverse direction. This behavior has some similarity to that of hulls of so-called tunnel boats which are known for being able to negotiate very sharp turns. S151 and S152 may include tunneled or vertical strakes, and these may be included without air tubes or chine ventilation.

Figure 3:
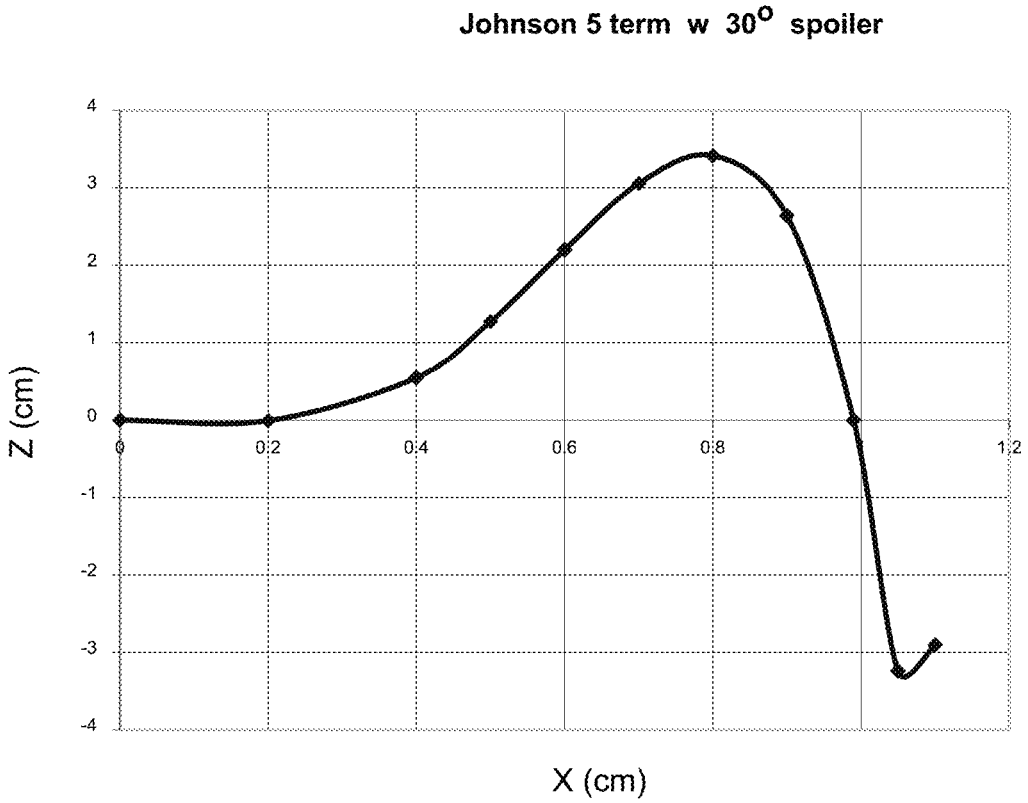
FIG. 3 shows a side view of a planing surface which starts with a Johnson five term camber and ends with a spoiler/angled interceptor and step in planing angle at the back end of the planing surface.

FIG. 3 shows yet another aspect of some exemplary embodiments. The x-axis is the longitudinal direction at the centerline of the hull. The-z axis is perpendicular to the x-axis in the vertical direction. The first five plotted points (from left to right) trace a curve which is approximately a Virgil Johnson five term camber. The three remaining points (again from left to right) trace an exemplary spoiler. In some embodiments, one or more planing surfaces (e.g., S2, S73, or S15) are cambered over at least part of their length. In some embodiments, at least part of S73 is cambered in a longitudinal direction. For example, S73 (and/or other planing surfaces) may comprise a Johnson five term camber or Johnson three term camber. Other planing surfaces may also be cambered, e.g., with either a Johnson five term or three term camber. With a Johnson camber, the lift/drag is generally greatest if the planing angle is 2 degrees or less. Thus it is desirable that planing prism width of the bow is small, but if a wave comes or the sailor gets too far forward the nose of the board does not generally go under water because of the outside tunnels 71 and 72 that end in a step 81. "Planing prism" refers to S73, and "planing prism width" is any width of S73.

An exemplary hull, in particular at the aft end of a planing surface (e.g., S2, S73, or S15), may comprise a spoiler and/or interceptor at an end of a (longitudinally) cambered surface, e.g., at the end of a Johnson five term camber or Johnson three term camber. FIG. 3 illustrates a camber that is similar to a Johnson five term or an extension but with more camber/angle closer to the aft end and/or spoiler/interceptor at some angle to increase the lift. FIG. 3 shows the entire curve for a Johnson five term camber with the 2D lift at $\tau=0$ ($\tau$ is planing angle, also sometimes represented as $\alpha$), $C_{ld}$,=0.2 ($C_{ld}$ is the two dimensional lift coefficient for a cambered surface when the planing angle is zero) and with a spoiler at beta 33° and a height of 3.3 cm. The first five plotted points (from left to right) correspond with a Virgil Johnson five term camber. The three remaining points (again from left to right) correspond with the spoiler. This give a two-dimensional lift coefficient ($C_L$) of about 0.5, a lift to total drag of greater than ~12.5 for a chord of 100 cm, and an end depth of 3.3 cm below the start of the curve with a hull planing angle of zero. The spoiler may also be curved in the longitudinal direction and may have a second derivative with an increasing magnitude. This means that a 98 cm model sailboard should have over 300 pounds of planing lift at only 6 MPH board speed, 230 lb. just for the 100×66 sq·cm. of the main lift surface. This is a conservative estimate of lift for the board as hull, since it does not include any lift from the center 30 cm of the board width which is the surface which contains the fins for the sailboard.

EXAMPLES

Example 1. Effects of a Tunnel Bow as Compared to a Reference Model

A test was performed to evaluate the performance of a model generally having a bow consistent with S7 of FIG. 1A (in brief, a bow with tunnels on the outside each ending in a step). The object was to achieve no hump drag at the start of planing speed or else less than no hump (i.e., achieve a drag at the start of planing speed equal to or lower than the minimum drag in planing mode).

Figure 5:
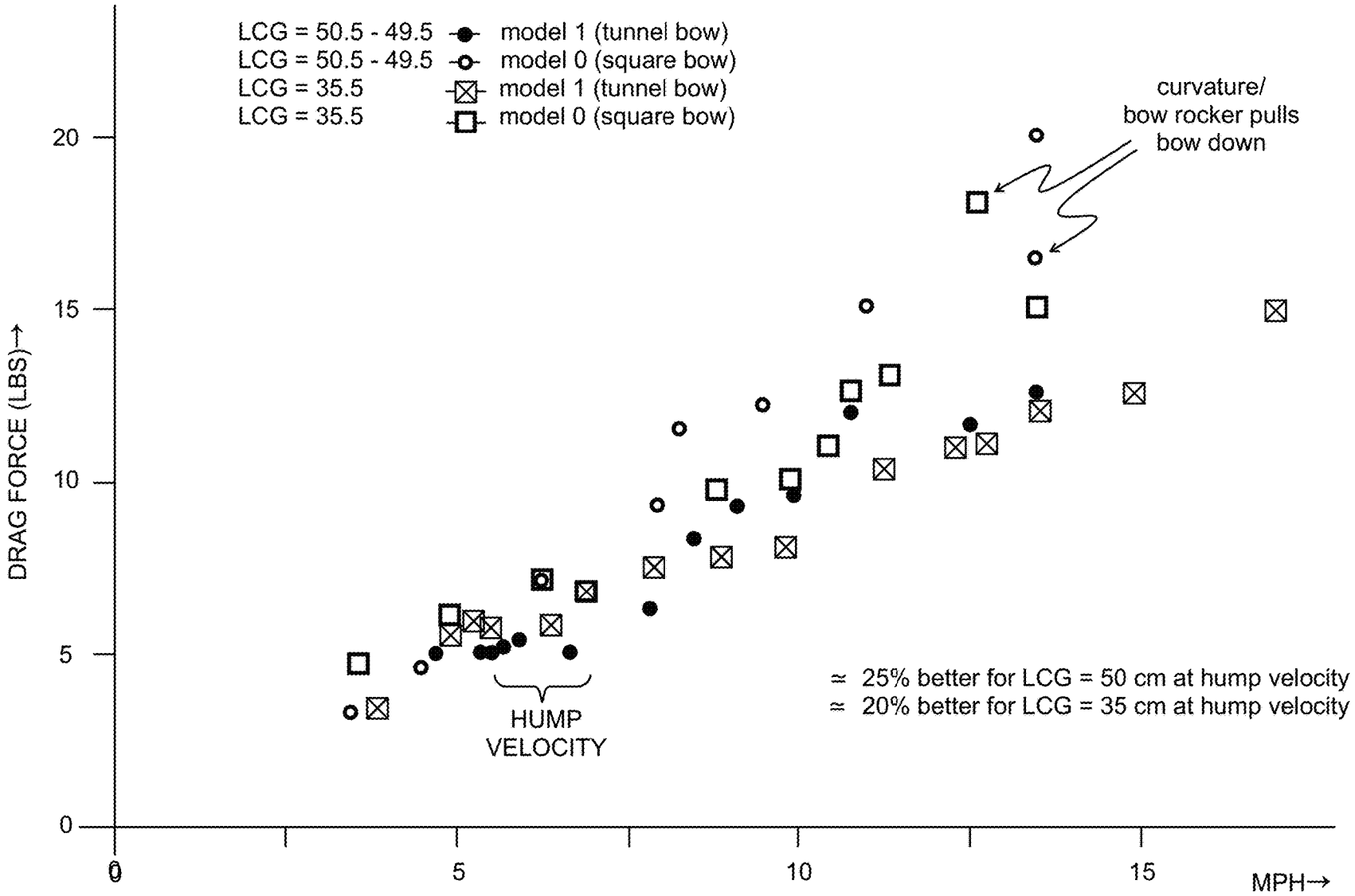
FIG. 5 shows drag force for experimental model hulls.
Figure 6:
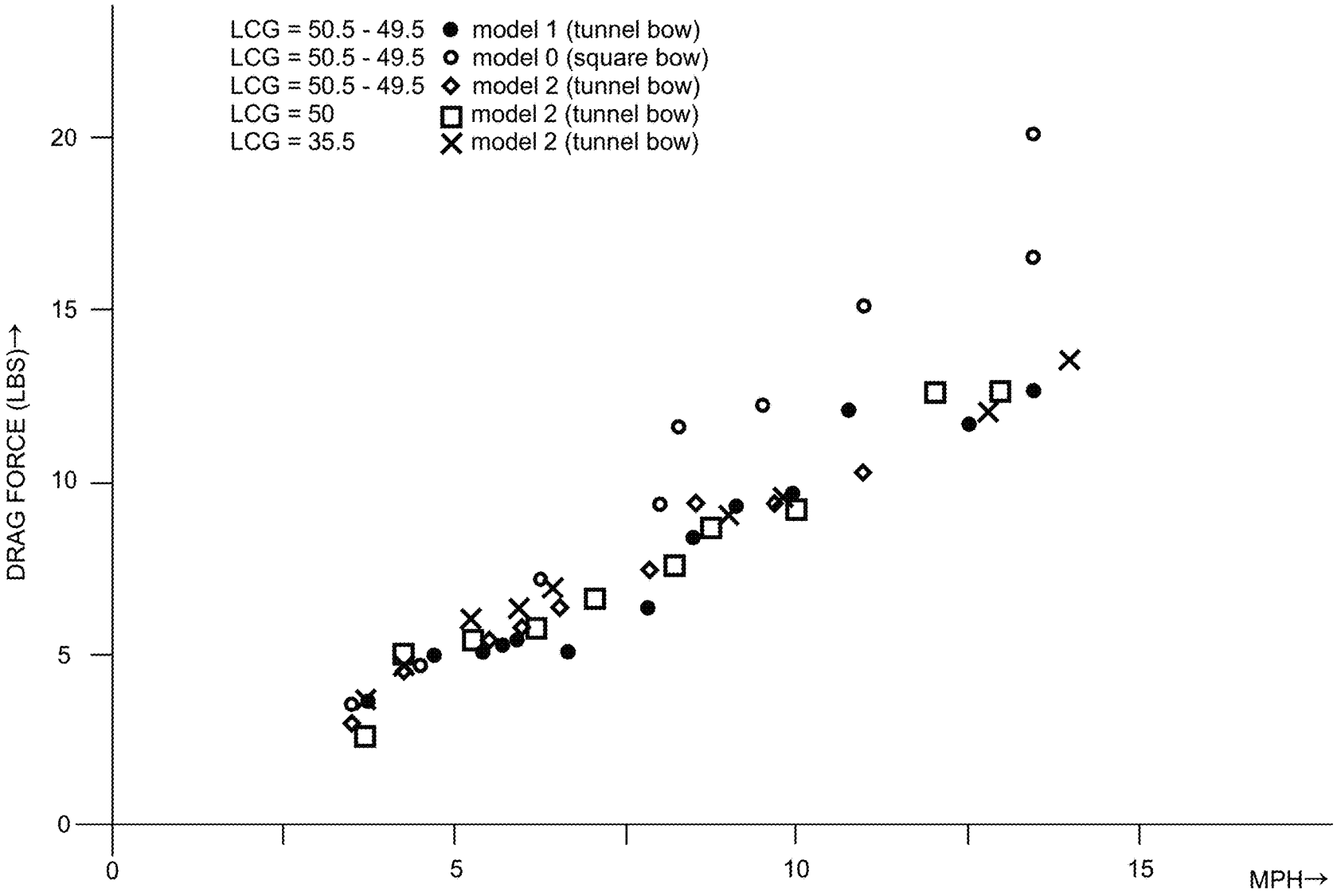
FIG. 6 shows drag force for experimental model hulls.

FIG. 5 presents performance data for two models. One model had a "square bow" design and is referred to herein as model 0. Model 0 had a length of 120 cm and contained Vergal Johnson curves near the back.

The next model (referred to as "model 1" or the "tunnel bow" design) was then constructed from model 0, with the result that features not under study were identical between model 0 and model 1. Unlike model 0, model 1 comprised a parabolic nose at the center of the bow with zero dead rise. Also unlike model 0, model 1 comprised a tunnel on either side of the bow center, and each tunnel ended in a step. Model 0 did not have the tunnels or the steps at the end of tunnels.

Both model 0 and model 1 were weighted to have a total weight of 27 pounds during all tests and data collection.

An objective was to achieve a lift to drag ratio of approximately 7, or a drag about $1/7^{th}$ of the hull's total weight, at the hump velocity. Experimentally, the lowest planing drag of the square bow design (model 0) was about ⅕th of the total weight. Some of the drag was attributed to a rocker at the hull's bow. The square bow design had a rocker on the bow the curvature of which pulled the bow down at high speed, thus increasing the drag at high speed. The drag may be further reduced by reducing the rocker at the front of the bow.

The data presented in FIG. 5 indicates about 20 or 25% less drag with the tunnel bow (model 1) than the original square bow (model 0), for a longitudinal center of gravity (LCG) of 35 or 50 cm respectively at the hump velocity.

A model 2 was then fashioned from the body of model 1. A number of changes were performed: 1) the amount of rocker in front of the bow was reduced since the front surface of the board was in the water only for an LCG of 50 cm or slightly more than 50 cm; 2) a greater deadrise angle in the front, 3) a chine angle of ≈−20 degrees, 3) a modification to the back of the model to have no foil.

Mathematically, there are three unknowns to consider for each LCG: "S" which is the drag of the hull models 0 and 1 from surfaces of the hull aft of the bow, "B0" which is the drag of the bow of model 0; and "Bt" which is the drag of the model 1. The following two assumptions may be made: 1) for the case of LCG=50 cm from the stern, S=B0=50% of the drag, and 2) for LCG=35 cm from the stern, where much less of the bow is in the water (in both models 0 and 1) S=75% of the drag.

The lift to drag ratio can then be calculated with two equations and two assumptions at a speed where the measured improvements were respectfully 25% and 20% going from the square bow to the tunnel bow. The result of the calculation is a 30% improvement for the LCG=50 cm and a 25.5% improvement for LCG=35 cm for the tunnel bow if the original model 0 would have had a lift to drag of 7. A lift to drag of 7 was the Lift/Drag measured for both a' scale model of the sailboard and the 160 cm yacht model. Separately, a lift/drag of up to 9 was experimentally measured on a 240 cm long full size sailboard.

While exemplary embodiments of the present invention have been disclosed herein, one skilled in the art will recognize that various changes and modifications may be made without departing from the scope of the invention as defined by the following claims.

What we claim is:

1. A bow for a watercraft hull with a hull length, comprising a center surface at least part of which is cambered in a longitudinal direction, wherein the center surface has an aft end;

two tunnels, one to port side and one to starboard side of the center surface; and a step in depth or planing angle at an aft end of each of the two tunnels, wherein a width of the bow equals a sum of a width of the center surface and widths of the two tunnels, and each step's location measured along a longitudinal direction of the hull is 0 to 15% of the hull length either fore or aft of a location of the center surface's aft end.

2. The bow of claim 1, wherein the center surface comprises a Johnson five term camber or Johnson three term camber.

3. The bow of claim 1, further comprising a spoiler and/or interceptor at an aft end of the part which is cambered in a longitudinal direction.

4. The bow of claim 3, wherein the spoiler and/or interceptor is configured at an angle of 10 to 90 degrees and a nonzero height.

5. The bow of claim 1, wherein for each of the two tunnels, the tunnel and the center surface are separated by a sharp chine or spray deflector.

6. The bow of claim 1, configured as the bow of a yacht, further comprising a step in depth or planing angle at an aft end of the center surface.

7. The bow of claim 1, configured as the bow of a sailboard, wherein the center surface has no step at an aft end thereof or has a step in depth or planing angle configured so as not to ventilate a fin aft of the step during use.

8. A watercraft hull comprising, from stem to stern, a front lift surface, wherein the front lift surface comprises a center surface at least part of which is cambered in a longitudinal direction, wherein the center surface has an aft end, two tunnels, one to port side and one to starboard side of the center surface, and a step in depth or planing angle at an aft end of each of the two tunnels;

a main lift surface; and a rear lift surface, wherein the hull has a length, a width of the front lift surface equals a sum of a width of the center surface and widths of the two tunnels, and each step's location measured along a longitudinal direction of the hull is 0 to 15% of the hull length either fore or aft of a location of the center surface's aft end.

9. The watercraft hull of claim 8, wherein the rear lift surface comprises a tunneled surface behind the main lift surface for longitudinal stability.

10. The watercraft hull of claim 9, wherein the rear lift surface comprises one or more deadrises and/or one or more strakes to either side of the tunneled surface.

11. The watercraft hull of claim 8, wherein one or more planing surfaces including the center surface comprises a Johnson five term camber or a Johnson three term camber.

12. The watercraft hull of claim 11, wherein at least one of said one or more planing surfaces comprises a spoiler and/or interceptor at an end of the part which is cambered in a longitudinal direction.

13. The watercraft hull of claim 12, wherein the spoiler and/or interceptor is configured at an angle of 10 to 90 degrees and a nonzero height.

14. The watercraft hull of claim 8, wherein for each of the two tunnels, the tunnel and the center surface are separated by a sharp chine or spray deflector.

15. The watercraft hull of claim 8, wherein the watercraft hull is configured as a yacht hull, further comprising a step in depth or planing angle at an aft end of the center surface.

16. The watercraft hull of claim 8, wherein the watercraft hull is configured as a sailboard hull comprising a fin, wherein the center surface has no step at an aft end thereof or has a step in depth or planing angle configured so as not to ventilate the fin.

17. The watercraft hull of claim 8, wherein the watercraft hull is the hull of a power boat, surfboard, sailboard, standup paddle (SUP) board, kiteboard, or wakeboard.

* * * * *